United States Patent [19]

Göransson et al.

[11] Patent Number: 4,673,417

[45] Date of Patent: Jun. 16, 1987

[54] RIGID DISCHARGE ELECTRODE

[75] Inventors: Rolf Göransson; Henrik Stomberg, both of Växjö , Sweden

[73] Assignee: Fläkt AB, Nacka, Sweden

[21] Appl. No.: 794,534

[22] Filed: Nov. 4, 1985

[30] Foreign Application Priority Data

Nov. 5, 1984 [SE] Sweden ..... 8405540

[51] Int. Cl.[4] ..... B03C 3/04; B03C 3/41

[52] U.S. Cl. ..... 55/148; 55/152

[58] Field of Search ..... 55/13, 112, 113, 140, 55/148–150, 152; 361/222

[56] References Cited

U.S. PATENT DOCUMENTS

| | | | |
|---|---|---|---|
| 1,857,903 | 5/1932 | Wensley et al. | 55/140 X |
| 2,195,431 | 4/1940 | Shively et al. | 55/150 X |
| 2,369,967 | 2/1945 | Hedberg et al. | 55/140 |
| 3,483,671 | 12/1969 | Wiemer | 55/152 X |
| 3,553,939 | 1/1971 | Dyla | 55/130 X |
| 4,115,083 | 9/1978 | Hüppi | 55/148 |
| 4,126,434 | 11/1978 | Keiichi | 55/152 X |
| 4,277,258 | 7/1981 | Bojsen | 55/152 |
| 4,303,418 | 12/1981 | Coe, Jr. | 55/152 X |
| 4,375,364 | 3/1983 | Van Hoesen et al. | 55/152 |
| 4,412,850 | 11/1983 | Kurata et al. | 55/130 |
| 4,514,195 | 4/1985 | Coe, Jr. | 55/152 |
| 4,521,229 | 6/1985 | Baker et al. | 55/137 |

FOREIGN PATENT DOCUMENTS

| | | | |
|---|---|---|---|
| 1101372 | 3/1961 | Fed. Rep. of Germany | 55/152 |
| 2904153 | 8/1980 | Fed. Rep. of Germany | 55/152 |
| 1247685 | 10/1960 | France | 55/140 |
| 842075 | 7/1960 | United Kingdom | 55/152 |
| 1100328 | 1/1968 | United Kingdom . | |

*Primary Examiner*—Robert Spitzer

*Attorney, Agent, or Firm*—Burns, Doane, Swecker & Mathis

[57] ABSTRACT

A rigid discharge electrode (2) intended for use in an electrostatic precipitator which, in addition to the discharge electrode, also includes one or more collector electrodes. A voltage source is provided for supplying energy to the discharge and collector electrodes, so as to create therebetween a high d.c. voltage and an electric field, causing dust to be separated from a dust-laden medium passing between the electrodes, this separated dust settling primarily on the collector electrodes. The discharge electrode comprises a rod-like member (10) having attached therealong a plurality of electrode parts (17,18) presenting one or more discharge tips. The electrode parts extend transversely to the longitudinal axis of the rod-like member and project beyond the outer defining surfaces thereof. The rod-like member (10) presents two mutually opposite and mutually parallel surfaces (19,19'), and elonagated electrode parts (17,18) presenting discharge tips (**17*a*,17*b***) are attached to or fitted on these surfaces.

21 Claims, 7 Drawing Figures

RIGID DISCHARGE ELECTRODE

TECHNICAL FIELD

The present invention relates to a rigid discharge electrode, and in particular to a rigid discharge electrode intended for electrostatic precipitators. In addition to said discharge electrode, the electrostatic precipitator is also provided with collector electrodes arranged in side-by-side relationship. The precipitator is also provided with a voltage source from which energy is supplied to the two electrodes, so as to create an electric field therebetween.

The field created by the high d.c. voltage occurring between the electrodes causes dust present in a dust-laden medium flowing between the electrodes to separate from said medium and settle primarily on the collector electrodes.

The present invention relates in particular to that kind of discharge electrode comprising a rod-like member having attached thereto a plurality of electrode parts presenting one or more discharge electrode tips, said electrode parts being distributed along the rod-like member and extending beyond the outer defining surfaces thereof.

BACKGROUND PRIOR ART

Various kinds of discharge electrodes of this kind are known to the art, and can be classified under two separate groups. In the first category or group of electrodes there is employed a frame structure having attached to mutually opposing parts thereof a plurality of mutually parallel conductors, normally laid in a helical configuration, and the d.c. voltage is applied to the frame structure.

The upper part of the frame structure is normally held by a carrier means.

The other category, or group of discharge electrodes are designated "rigid discharge electrodes" which are self-supporting and comprise an elongated member having attached thereto a plurality of electrode parts which present one or more discharge electrode tips. These electrode parts are distributed along the rod-like member and extend beyond the outer defining surfaces thereof. A rigid or self-supporting transmission electrode of this kind is attached at its upper part to a carrier means.

The discharge electrode described and illustrated in U.K. patent specification 1 100 328 constitutes an example of such prior art discharge electrodes.

DISCLOSURE OF THE PRESENT INVENTION

Technical Problems

With regard to the present state of this art it is apparent that a pronounced technical problem lies in the provision of such rigid discharge electrodes, comprising electrode parts and discharge electrode tips extending along the rod-like member, which can be used in large numbers in all electrostatic precipitators and which can be manufactured in lengths of up to 15 meters and given an external configuration which enables a plurality of such electrodes to be transported close together, preferably in bundles, from a manufacturing site to an installation site.

A further technical problem in this respect is one of providing discharge electrodes, with associated electrode parts and discharge tips, of such configuraiton that when a plurality of discharge electrodes are arranged close together and positioned horizontally for bundled transportation, the weight of mutually adjacent discharge electrodes will not bear on the discharge tips of associated further electrodes so as to plastically deform the discharge tips.

A further qualified technical problem is one of providing conditions whereby the discharge electrode can be readily formed so as to provide in the electrostatic precipitator a uniform distribution of current combined with a low ignition voltage for a corona build-up and fulfil the desideratum of being able to construct double rows of discharge tips.

Another technical problem is one of providing a flexurily rigid discharge electrode of such form that, in addition to affording a solution to the aforesaid technical problems, can also be firmly attached at its upper end to an electrode holding device in a torsion-rigid manner, without needing to take troublesome measures at the other end of the discharge electrode.

Another technical problem connected with the provision of a flexurily rigid discharge electrode which affords a solution to the aforesaid technical problem is one of providing conditions which enable the upper end of the discharge electrode to be readily attached to an electrode holding device without danger of angular error at the point of attachment, wherewith the attachment can be made so that respective discharge electrodes among a plurality of electrodes forming an electrode row do not only obtain a precise relationship with the adjacent collector electrodes but that the discharge tips of the discharge electrodes are also given a predetermined alignment in relation to the collector electrodes.

A further technical problem is one of providing a rigid discharge electrode which not only affords a solution to the aforesaid technical problem but which is also of such simple configuration that the discharge electrodes can be manufactured substantially without the aid of jigs or like devices, and in all events without requiring the use of complicated machines.

Finally, it will be seen that another technical problem is one of providing a discharge electrode in which the co-action between the rod-like member and the electrode parts is of such a nature that impact forces acting on the discharge electrodes, in order to remove dust collecting thereon, are also effectively distributed to all discharge tips.

SOLUTION

The present invention relates to a rigid discharge electrode intended for use in electrostatic precipitators. In addition to the aforesaid rigid discharge electrodes, the electrostatic precipitator also incorporates one or more collector electrodes, with both electrode types being arranged vertically, and also a voltage source which is intended to supply energy to the two electrodes so as to create therebetween a high d.c. voltage and resultant electric field. The electric field created between the electrodes influences dust in a dust-laden medium passing between the electrodes, so as to separate dust from the medium, this separated dust settling primarily on the collector electrodes.

The present invention has as its starting point a rigid discharge electrode comprising a rod-like, self-supporting member having attached therealong a plurality of electrode parts which present one or more discharge-electrode tips and which extend beyond the outer defining surfaces of the member.

In accordance with the present invention, the rod-like member presents at least two mutually opposite and mutually parallel surfaces to which elongated electrode parts presenting discharge-electrode tips are attached.

In accordance with a particularly advantageous embodiment of the invention, a rod-like member has a right-angled cross-section, preferably a square cross-section, and may be formed from a standard hollow profile, and the electrode parts attached to the planar surfaces presented by the rod-like member conveniently have a length corresponding from two to four times the width of said member. The electrode parts are preferably inclined to a centre line on the rod-like member.

In accordance with another embodiment of the invention, a first plurality of electrode parts are attached to one surface and a second plurality of electrode parts are attached to the other surface extending parallel to the first-mentioned surface, said first and said second pluralities of electrode parts being mutually off-set along the rod-like member and/or rotated in relation to one another.

One end part of one planar surface is arranged to face a carrier or a holding device, for supporting and positioning the discharge electrodes between the collector electrodes.

Clamping means effective to create a clamping force are arranged to rest at one end thereof against said holding device. The securing means is intended to extend through the aforesaid two planar surfaces. In addition, there is conveniently provided a sleeve whose one end part passes the planar surface facing the holding device, while the other end part of said sleeve serves as a support for the planar surface facing away from the holding device. The other end part of the securing means co-acts with a clamping device.

In accordance with one embodiment of the invention the securing means has a form of a bolt, while the clamping device has the form of a nut. The bolt is received in holes provided in the holding device and the planar surface facing away from said device, these holes being larger than the cross-section of the bolt. The planar surface facing the holding device is provided with a hole which is somewhat larger than the cross-sectional dimension of the sleeve.

ADVANTAGES

Those advantages primarily afforded by a rigid discharge electrode according to the present invention reside in the external configuration of the electrode, which enables a plurality of discharge electrodes to be readily packed together in bundle form without risking damage, such as plastic deformation, to the electrode tips formed on the electrode parts of the discharge electrode. In addition, the discharge electrode can be readily attached to a holding device and held rigid against torsional forces. Another advantage afforded by the invention is that the discharge electrode can be manufactured without the use of complicated auxiliary devices.

The primary characteristic features of a rigid discharge electrode constructed in accordance with the present invention are set forth in the characterizing clause of the following claim 1.

BRIEF DESCRIPTION OF THE DRAWINGS

A number of proposed embodiments of a rigid discharge electrode according to the invention will now be described with reference to the accompanying drawing, and with reference to the use of such an electrode, in which drawings.

DESCRIPTION OF PREFERRED EMBODIMENTS

Figure 1:
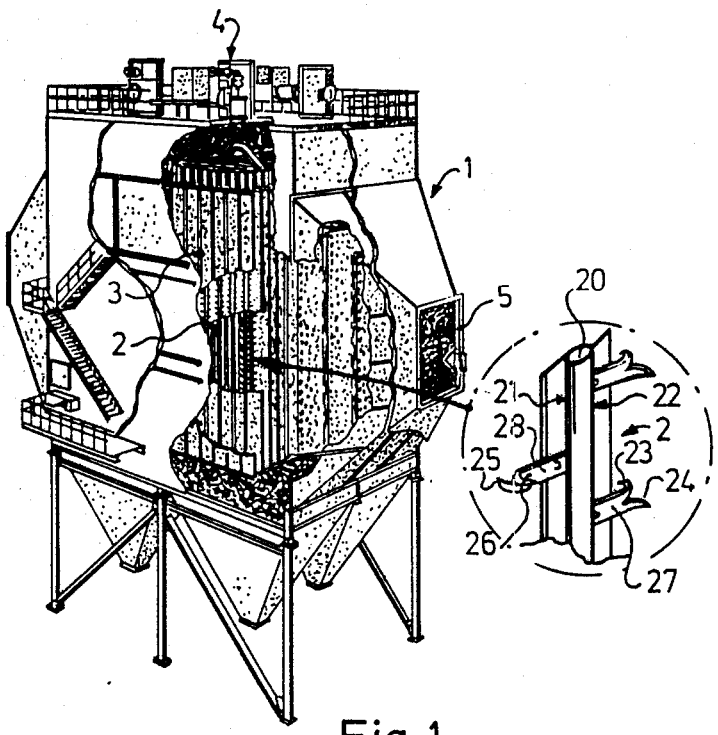
FIG. 1 is a perspective view of a prior art electrostatic precipitator having installed therein prior art rigid discharge electrodes.

Illustrated in FIG. 1 is an electrostatic precipitor 1 which has provided therein a plurality of discharge electrodes 2 and a plurality of collector electrodes 3, with the discharge electrodes 2 arranged in a plurality of mutually parallel planes, and the collector electrodes, in turn, also being arranged in a plurality of mutually parallel planes and being positioned between respective discharge electrodes. The illustrated electrostatic precipitator 1 also includes a known voltage source (not shown) connected at the location 4 in FIG. 1. The voltage source is intended to supply energy to the discharge and collector electrodes 2 and 3, so as to create therebetween a high d.c. voltage and to generate an electric field.

The electric field created between the electrodes causes dust suspended in a dust-laden medium entering through an inlet 5 and passing between the electrodes to be separated from the medium and settle primarily on the collector electrodes 3. A certain amount of dust, however, will also settle on the discharge electrodes.

The prior art discharge electrode comprises a rod-like member in the form of a circular tube 20 to which there is attached a plurality of electrode parts 27,28 having formed thereon one or more discharge-electrode tips 23, 24 and 25, 26. The electrode parts 27,28 are distributed along the rod-like member 20 and extend transversely thereto beyond the outer defining surfaces 21,22 of said member, in the manner illustrated in the enlarged part-view of FIG. 1.

Figure 2:
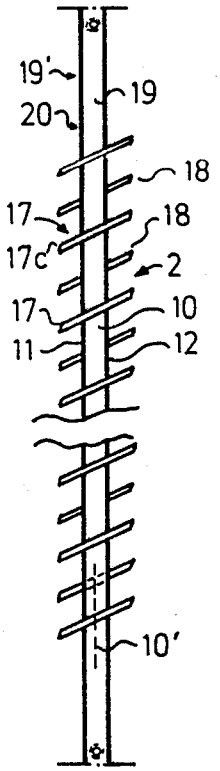
FIG. 2 is a side view of a first embodiment of a rigid discharge electrode in accordance with the present invention.

FIG. 2 is a side view of a rigid discharge electrode according to the present invention, this electrode also comprising a rod-like member 10. The member 10 has distributed therealong a plurality of electrode parts which extend transversely to the longitudinal axis of the member and project beyond the outer defining surfaces 11,12 thereof. A first plurality, 17, of said electrode parts are attached to one defining surface 19 of said member 10, and a second plurality, 18, of said electrode parts are attached to a surface 19' opposite said defining surface 19.

The rod-like member 10 is thus arranged to present at least two mutually opposite and mutually parallel planar surfaces, either the surfaces 19 and 19' or the surfaces 11,12, so that the elongated electrode parts 17,18 can be attached to respective mutually opposite planar surfaces.

Figure 4:
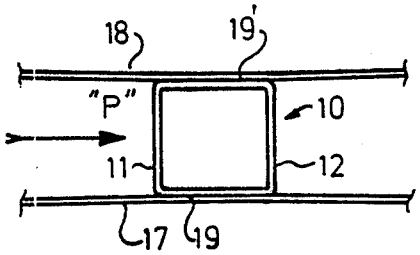
FIG. 4 is a horizontal view in larger scale of the discharge electrode illustrated in FIG. 2.

In accordance with one preferred embodiment of the present invention, the elongated member 10 has a right-angled cross-section, preferably a square cross-section, such as to present the aforesaid mutually parallel surfaces 19, and 19' to which respective electrode parts 17 and 18 are attached. In addition, the member 10 presents other plane-parallel, mutually opposite defining surfaces 11,12 facing towards and away from the direction of flow "P" of the medium, as seen more clearly from FIG. 4.

Figure 3:
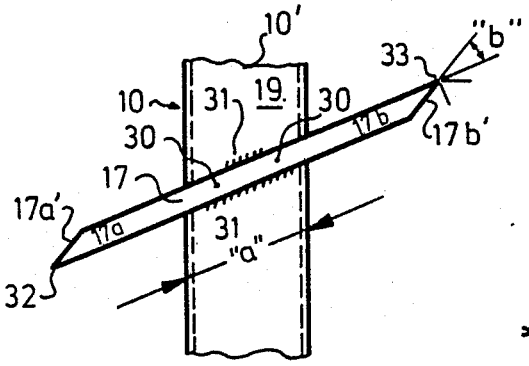
FIG. 3 is a side view in larger scale of part of the discharge electrode illustrated in FIG. 2, illustrating more clearly the positioning and attachment of an electrode part to a rod-like member.

FIG. 3 illustrates in somewhat larger scale part of the elongated member 10 and an electrode part 17 attached thereto. The electrode part 17 can be attached to the planar surface 19 by spot welds 30 or by means of one or two weld beads 31,31'. The length of the electrode part 17 is three times the geometric extension of the elongated member 10 in a plane common to the electrodes, namely the illustrated distance "a". The electrode part 17 is also attached to the elongated member 10 so as to be inclined relative to a centre line 10' on the member 10.

The angle at which the electrode parts are inclined is contingent on a pre-determined electrode-tip distribution effective to provide satisfactory current distribution and a homogenous electric field between the electrodes. This angle of inclination is also chosen with a view of enabling similarly located electrode parts on a plurality of finalised discharge electrodes packed in a bundle for transportation purposes, preferably with uniform bundle end-surfaces, to be positioned in relation to one another side-by-side and/or with a given spacing therebetween.

The electrode part 17 comprises material of right-angled, preferably rectangular cross-section and is cut obliquely at the end portions **17*a*, 17*b* to form a respective discharge-electrode tip 32 and 33** on an electrode part. The angle "b" subtended by the surfaces defining the discharge tip is between 20° and 40°, preferably about 30°.

As will readily be understood, each electrode part 17 may be produced by clipping the electrode part from strip material, whereby the cut surface forms the surfaces **17*a'* and 17*b'*** of two separate electrode parts.

Referring again to FIG. 2, it is shown that a first plurality of electrode parts 17 are attached to the one planar surface 19, and that a second plurality of identical electrode parts 18 are attached to the opposite planar surface 19', and that each electrode part 17 is off-set in relation to each electrode part 18. This mutual displacement of the electrode parts is such that the electrode parts 18 are located centrally between two mutually adjacent electrode parts 17. This configuration is chosen so that a plurality of discharge electrodes can be bundled together for transportation, such that a surface 12 on the elongated member 10 will lie immediately adjacent a surface 11 on an adjacent discharge electrode, whereby the electrode parts 17 and 18 will be located on a respective side of the surface corresponding to surfaces 19, 19' of the further discharge electrode in the manner illustrated. The electrode parts of the further discharge electrode are, in a similar manner, located adjacent a respective surfaces 19,19' of the discharge electrode illustrated in FIG. 2. This arrangement enables a plurality of discharge electrodes to be packed close together and transported, without danger of damage to the discharge tips of the electrodes. In order to protect the discharge tips of the outermost electrodes, a rectangular wooden batten (not shown) or the like can be placed against the surface 12, the width of the batten exceeding the distance of the discharge tips to the surface 12.

Figure 5:
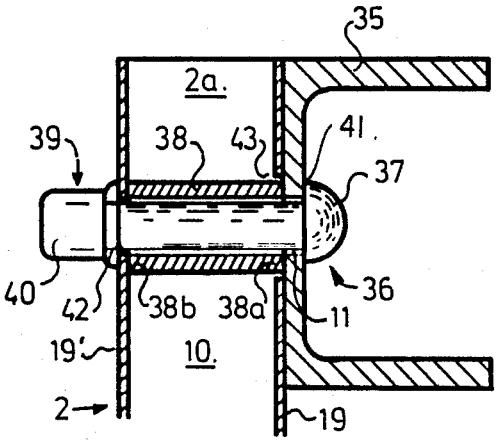
FIG. 5 is a side view, partly in section, of a securing device for securing a discharge electrode to a holder, said device being effective to produce a clamping effect.

As illustrated in FIG. 5, one end part of the planar surface 19, the upper part **2*a* of the discharge electrode 2, is arranged to face towards a holder 35, in the form of a U-beam, adapted to hold and position the elongated member 10** and discharge electrodes attached thereon between the collector electrodes, and to secure the discharge electrodes against torsional forces and without risk of angular error upon attachment.

FIG. 5 also illustrates a fastener means 36 which is effective to produce a clamping effect and one end part 37 of which is arranged to rest against the holder 35. The fastening or securing means 36 extends through the two planar surfaces 19,19', and one end part **38*a* of a sleeve 38 is arranged to pass the planar surface 19 facing the holder, whereas the other end part 38*b* is arranged to serve as a support for the planar surface 19' facing away from the holder 35. The other end part 39 of the securing means 36 co-acts with a clamping means 40**.

The securing means 36 preferably comprises a bolt, and the clamping means 40 preferably comprises a nut. The bolt 36 is arranged to pass through a hole 41 provided in the holder 35 and a hole 42 provided in the planar surface 19' facing away from the holder 35, the holes being slightly larger than the cross-dimension of the bolts 36. The aforesaid one end part of the sleeve 38 is accommodated in a hold 43 provided in the planar surface 19 facing the holder 35, this hole being of course slightly larger than the outer cross-dimension of the sleeve end-part.

Figure 6:
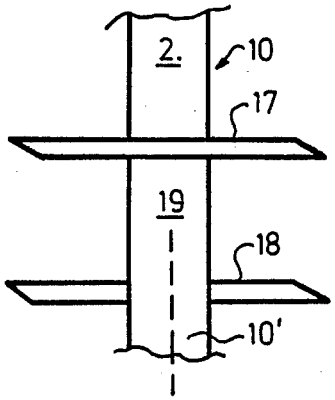
FIG. 6 is a side view of a second embodiment of a discharge electrode.

FIG. 6 illustrates a second embodiment of a discharge electrode, in which the electrode parts 17 and 18 are identical to those illustrated in FIG. 2 and positioned at right angles to the centre line 10' of the elongated member 10.

Figure 7:
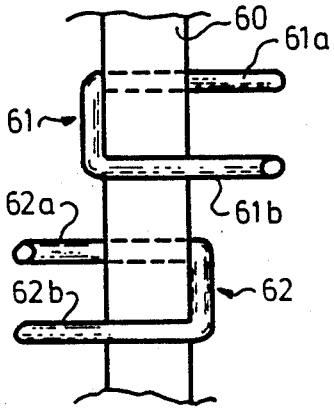
FIG. 7 is a side view of a fourth discharge electrode, all embodiments lying within the scope of the present invention.

FIG. 7 illustrates a fourth embodiment of the invention, in which the rod-like member 60 has a square cross-section and in which the electrode parts 61 and 62 have the form of conductors bent to the form of a right-angled "U", the distance between the legs again being greater than the cross-dimension of the member 60. The legs **61*a* and 61*b* of the electrode part 61 extend in a direction opposite to the legs 62*a* and 62*b* of the electrode part 60**.

The legs of the electrode part are attached to the rod-like member in a manner similar to that described with reference to the FIG. 3 embodiment.

The scope of the present invention also encompasses an embodiment in which electrode parts arranged on mutually opposing surfaces 19,19' are mutually symmetrically positioned, meaning that if the electrode parts 17' in FIG. 2 are positioned in one given manner, the electrode parts 18 shall be oriented to the surface 19' immediately adjacent the electrode parts 17, but with an angle of inclination relative to the centre line 10' on the member 10 (in a projection according to FIG. 2) forming supplementary angles therebetween.

This is effected by attaching the electrode parts 17 to the member 10 via electrode-part fixtures, rotating the member 10 through 180° and introducing electrode parts 18 into the same fixture and attaching said parts 18 to the surface 19'.

If the distribution of electrode parts 17 and 18 illustrated in FIG. 2 is desired, but with the electrode parts 17 and 18 forming supplementary angles, the same fixture for the electrode parts can also be used here, but if so the member shall be displaced axially to some extent prior to attaching the electrode parts 18.

It will be understood that the invention is not restricted to the aforedescribed and illustrated embodiments, but that modifications can be made within the scope of the following claims.

It will be understood, however, that the elongated member may have any suitable polygonal cross-section shape, so as to present multiples of mutually opposite planar surfaces.

We claim:

1. A rigid discharge electrode, comprising:

a rod-like member having at least two mutually opposite and mutually parallel surfaces;

two stacking surfaces interconnecting the two mutually opposite and mutually parallel surfaces;

a plurality of electrode parts attached to the opposite surfaces, said electrode parts extending along said surfaces and transversely to the longitudinal axis of the rod-like member;

each electrode part having a discharge tip projecting beyond the outer defining surfaces of the rod-like member;

wherein the electrode parts are inclined on the rod-like member relative to a center line thereon to allow one of the stacking surfaces of one rigid discharge electrode to lie flush against a stacking surface of an adjacent rigid discharge electrode;

one end of one of said opposite surfaces is arranged to face towards a holder for the rigid discharge electrode;

a securing means, effective to produce a clamping action, extends through both of said opposite surfaces, a first end part of the securing means rests against the holder;

a clamping device coacting with a second end part of the securing means to clamp the rod-like member to the holder; and a sleeve arranged on the securing means, said sleeve passing through the one opposite surface and abutting the other opposite surface.

2. A rigid discharge electrode according to claim 1, wherein each of said electrode parts has a rectangular cross-section.

3. The rigid discharge electrode according to claim 1, wherein each of said electrode parts is cut obliquely at an end thereof to form the discharge tip.

4. The rigid discharge electrode according to claim 1, wherein each electrode part has a discharge tip at each end thereof.

5. An electrode according to claim 1, wherein the rod-like member has a right square cross-section, and is formed from a hollow profile.

6. An electrode according to claim 5, wherein respective electrode parts have a length corresponding to twice or four times the width of the rod-like member.

7. An electrode according to claim 1, wherein the respective electrode parts have a length corresponding to twice the width of the rod-like member.

8. An electrode according to claim 1, wherein the electrode parts on one surface of the elongated member are off-set in relation to the electrode parts attached to the other surface of said member.

9. An electrode according to claim 8, wherein electrode parts arranged on mutually opposite surfaces of said elongated member are mutually symmetrically orientated.

10. An electrode according to claim 1, wherein the securing means comprises a bolt, and the clamping device a nut; the holder and the planar surface facing away from said holder are each provided with a respective hole and of slightly larger size than the cross-dimension of the bolt; and in the planar surface facing towards the holder is provided with a hole of slightly larger size than the outer cross-dimension of the sleeve.

11. An electrode according to claim 1, wherein respective electrode parts are taken from one strip of material and rod material, and are welded firmly to the rod-like member.

12. An electrode according to claim 1, wherein electrode parts are arranged in mutually symmetrical relationship on opposite sides of said rod-like member.

13. An electrode according to claim 1, wherein electrode parts arranged on mutually opposite surfaces of said rod-like member are mutually symmetrically orientated.

14. A rigid discharge electrode, comprising:

a rod-like member having two mutually parallel surfaces; and a plurality of electrode parts of a U-shaped configuration, each electrode part having parallel legs that are attached to the parallel surfaces of said rod-like member and extend transversely to the longitudinal axis of the rod-like member;

each electrode part having a discharge tip projecting beyond the outer defining surfaces of the rod-like member.

15. An electrode according to claim 14, wherein the distance between the legs of the U-shaped electrode parts is greater than the width of the rod-like member.

16. An electrode according to claim 14, wherein in the rod-like member is of square-cross-section, and in the distance between the legs of the U-shaped electrode parts is somewhat greater than the width of the rod-like member.

17. A rigid discharge electrode, comprising:

a rod-like member having at least two mutually opposite and mutually parallel surfaces said rod-like member having a rectangular cross section and being formed from a hollow profile;

a plurality of electrode parts attached to the opposite surfaces, said electrode parts extending along said surfaces and transversely to the longitudinal axis of the rod-like member;

each electrode part having a discharge tip projecting beyond the outer defining surfaces of the rod-like member;

means for holding and positioning the rod-like member between collector electrodes;

one end of said rod-like member having two planar surfaces, one of which is arranged to face said holding and positioning means and the other faces away from the holding and positioning means;

means for securing the rod-like member to the holding and positioning means, said securing means extending through the two planar surfaces, a first end part of the securing means rests against the holding and positioning means;

a clamping device coacting with a second end part of the securing means to clamp the rod-like member against the holding and positioning means; and a sleeve arranged on said securing means, said sleeve passing through the one planar surface and abutting the other planar surface.

18. The rigid discharge electrode according to claim 17, wherein each of said electrode parts is cut obliquely at an end thereof to form the discharge tip.

19. An electrode according to claim 17, wherein the electrode parts are inclined on the rod-like member relative to a centre line thereon.

20. An electrode according to claim 19, wherein the angle at which the electrode parts are inclined is contingent on a pre-determined discharge-tip distribution and is selected so that a plurality of discharge electrodes can be bundled together with the electrode parts of said electrodes placed close together with a given spacing therebetween.

21. An electrode according to claim 20, wherein electrode parts are arranged in mutually symmetrical relationship on opposite sides of said elongated member.

* * * * *